US006647891B2

(12) United States Patent
Holmes et al.

(10) Patent No.: US 6,647,891 B2
(45) Date of Patent: Nov. 18, 2003

(54) RANGE-FINDING BASED IMAGE PROCESSING RAIL WAY SERVICING APPARATUS AND METHOD

(75) Inventors: Quentin Holmes, Springfield, OR (US); Paul Kortesoja, Ann Arbor, MI (US); David McCubbrey, Ann Arbor, MI (US); Joseph Samson, Brighton, MI (US); Thomas Wessling, Howell, MI (US); Lester Witter, Saline, MI (US); Robert Rendleman, Anacortes, WA (US); John Blanchfield, Mooresville, NC (US); Gregory Lowe, Moneta, VA (US)

(73) Assignee: Norfolk Southern Corporation, Norfolk, VA (US)

( * ) Notice: Subject to any disclaimer, the term of this patent is extended or adjusted under 35 U.S.C. 154(b) by 0 days.

(21) Appl. No.: 10/013,530

(22) Filed: Dec. 13, 2001

(65) Prior Publication Data

US 2002/0078853 A1 Jun. 27, 2002

Related U.S. Application Data

(60) Provisional application No. 60/258,080, filed on Dec. 22, 2000.

(51) Int. Cl.[7] ..... E01B 9/02

(52) U.S. Cl. ..... 104/2; 250/559.31; 356/602

(58) Field of Search ..... 104/2, 7.1, 7.2, 104/12, 17.1; 250/559.33, 559.31, 559.46, 559.23, 237 G; 356/602, 603, 604, 608

(56) References Cited

U.S. PATENT DOCUMENTS 3,129,335 A * 4/1964 Stewart ..... 104/2
3,352,249 A * 11/1967 Plasser et al. ..... 104/7.1
3,381,626 A * 5/1968 Fagan et al. ..... 104/12
3,608,497 A * 9/1971 Plasser et al. ..... 104/12
3,659,345 A * 5/1972 Plasser et al. ..... 104/7.1
3,745,930 A * 7/1973 Dieringer ..... 104/17.1
3,753,405 A * 8/1973 Bryan, Jr. ..... 104/17.1
3,821,932 A * 7/1974 Theurer et al. ..... 104/7.2
3,942,000 A * 3/1976 Dieringer ..... 104/17.1
4,065,856 A * 1/1978 Waters ..... 104/7.1
4,341,160 A * 7/1982 Nielsen ..... 104/7.2
4,538,061 A * 8/1985 Jaquet ..... 104/7.2
4,655,142 A * 4/1987 Theurer et al. ..... 104/7.1
4,731,853 A * 3/1988 Hata et al. ..... 356/603
4,733,969 A * 3/1988 Case et al. ..... 356/623
4,760,797 A 8/1988 Stubbs et al. ..... 104/12
4,937,445 A * 6/1990 Leong et al. ..... 356/603
4,957,369 A * 9/1990 Antonsson ..... 356/608
5,090,329 A * 2/1992 Theurer ..... 104/7.1
5,157,840 A * 10/1992 Henttinen ..... 104/7.2
5,307,151 A * 4/1994 Hof et al. ..... 356/604
5,487,341 A 1/1996 Newman et al. ..... 104/17.1
5,613,442 A * 3/1997 Ahola et al. ..... 104/2
5,615,616 A * 4/1997 Scheuchzer et al. ..... 104/2
5,760,415 A * 6/1998 Hauck et al. ..... 250/559.33
5,812,269 A * 9/1998 Svetkoff et al. ..... 356/602

* cited by examiner

*Primary Examiner*—S. Joseph Morano
*Assistant Examiner*—Lars A. Olson
(74) *Attorney, Agent, or Firm*—Dykema Gossett PLLC

(57) ABSTRACT

A method and an apparatus for identifying a feature of a railway and deploying equipment for servicing same by image processing range data pertaining to the railway feature. The method includes identifying a feature of a railway, wherein the identifying involves processing an image corresponding to ranges to the feature. The apparatus includes a vision system for determining a range to a feature of the railway and means for positioning equipment relative to, for servicing, the feature, based on the range.

48 Claims, 7 Drawing Sheets

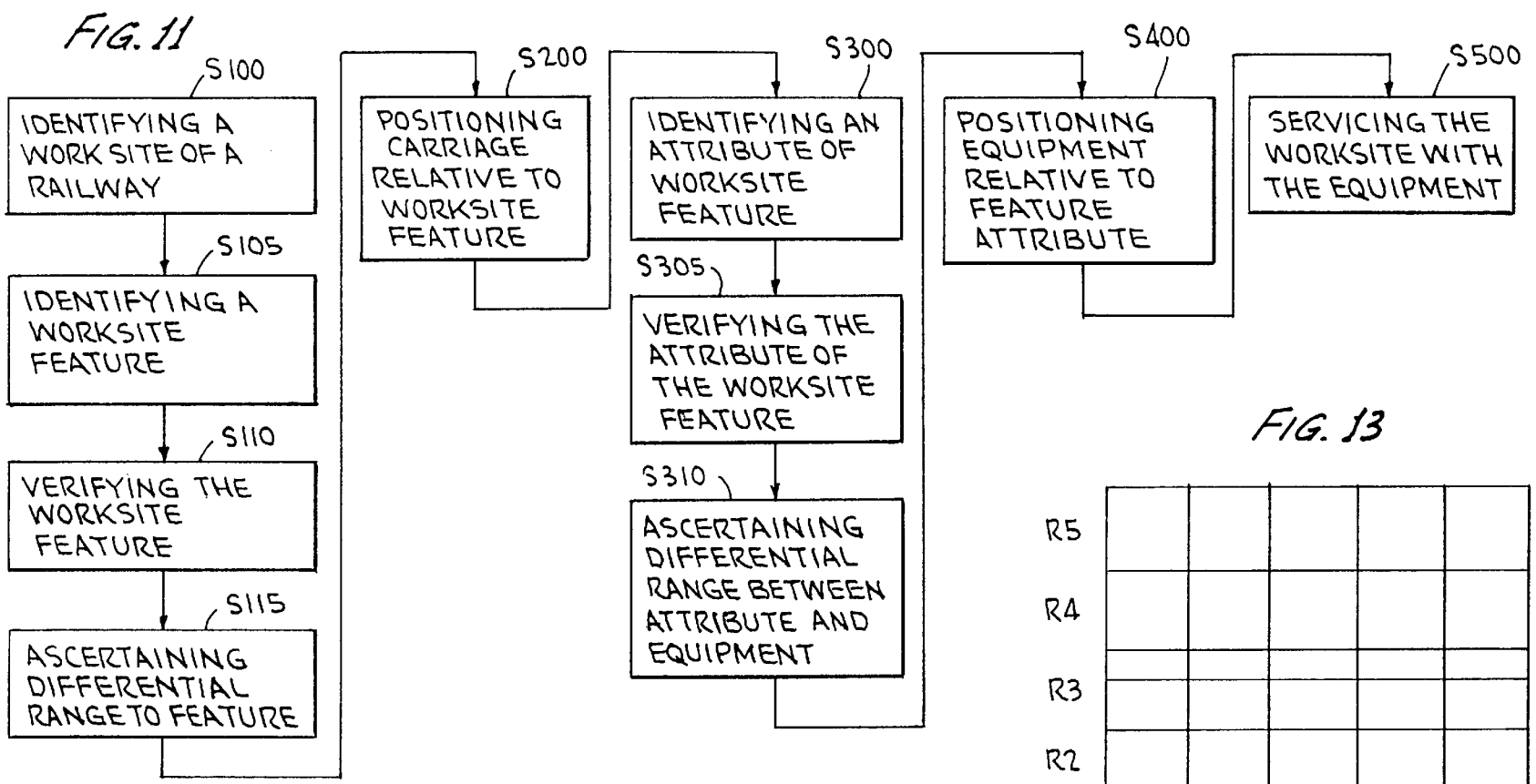
FIG. 11
S100
IDENTIFYING A WORK SITE OF A RAILWAY
S105
IDENTIFYING A WORKSITE FEATURE
S110
VERIFYING THE WORKSITE FEATURE
S115
ASCERTAINING DIFFERENTIAL RANGE TO FEATURE
S200
POSITIONING CARRIAGE RELATIVE TO WORKSITE FEATURE
S300
IDENTIFYING AN ATTRIBUTE OF WORKSITE FEATURE
S305
VERIFYING THE ATTRIBUTE OF THE WORKSITE FEATURE
S310
ASCERTAINING DIFFERENTIAL RANGE BETWEEN ATTRIBUTE AND EQUIPMENT
S400
POSITIONING EQUIPMENT RELATIVE TO FEATURE ATTRIBUTE
S500
SERVICING THE WORKSITE WITH THE EQUIPMENT

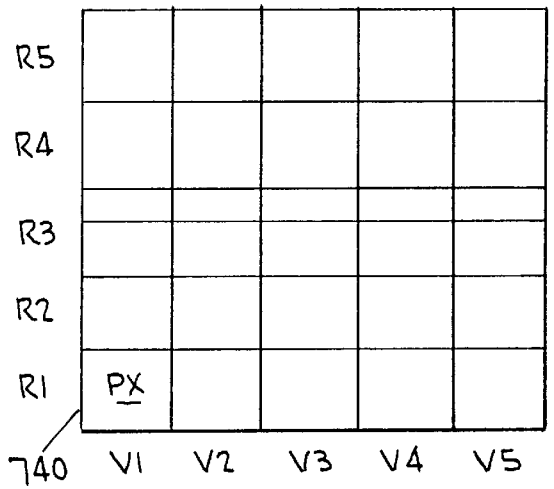
FIG. 13
R5
R4
R3
R2
R1
V1
V2
V3
V4
V5
PX
740

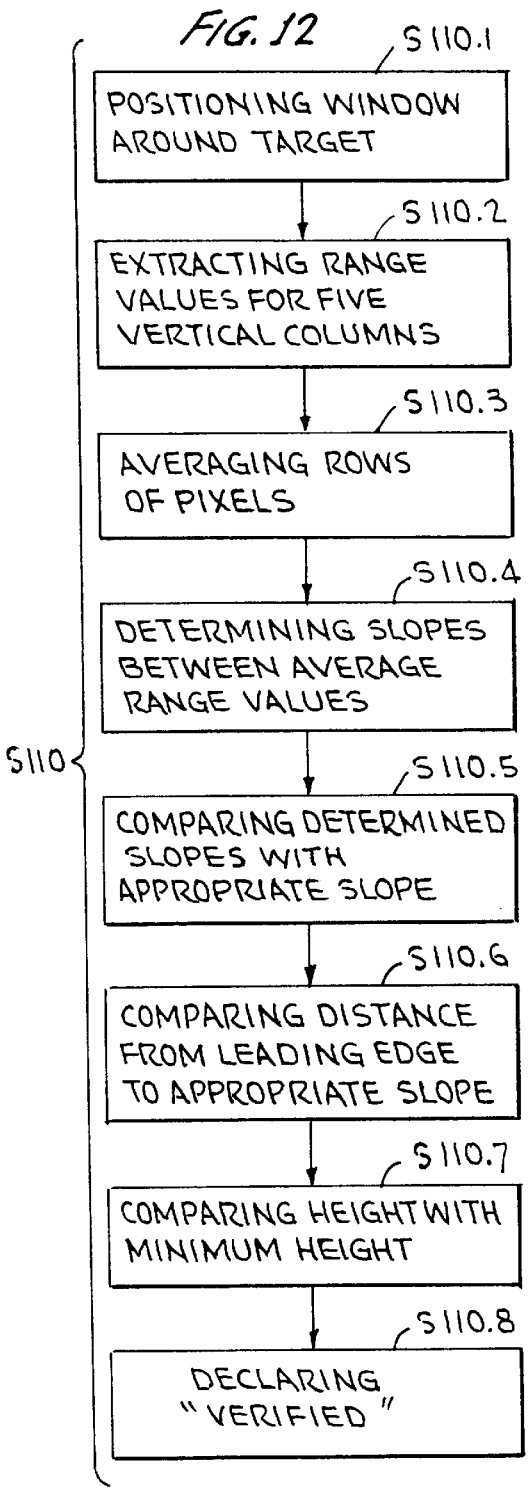
FIG. 12
S110
S110.1
POSITIONING WINDOW AROUND TARGET
S110.2
EXTRACTING RANGE VALUES FOR FIVE VERTICAL COLUMNS
S110.3
AVERAGING ROWS OF PIXELS
S110.4
DETERMINING SLOPES BETWEEN AVERAGE RANGE VALUES
S110.5
COMPARING DETERMINED SLOPES WITH APPROPRIATE SLOPE
S110.6
COMPARING DISTANCE FROM LEADING EDGE TO APPROPRIATE SLOPE
S110.7
COMPARING HEIGHT WITH MINIMUM HEIGHT
S110.8
DECLARING "VERIFIED"

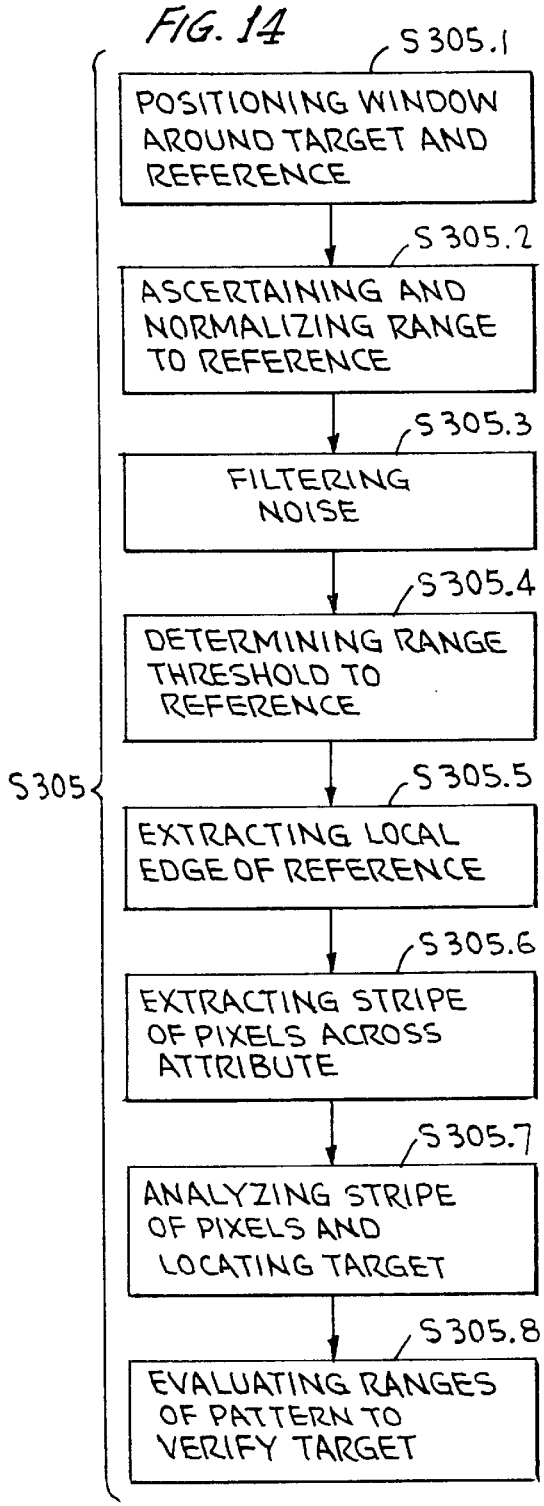
FIG. 14
S305
S305.1
POSITIONING WINDOW AROUND TARGET AND REFERENCE
S305.2
ASCERTAINING AND NORMALIZING RANGE TO REFERENCE
S305.3
FILTERING NOISE
S305.4
DETERMINING RANGE THRESHOLD TO REFERENCE
S305.5
EXTRACTING LOCAL EDGE OF REFERENCE
S305.6
EXTRACTING STRIPE OF PIXELS ACROSS ATTRIBUTE
S305.7
ANALYZING STRIPE OF PIXELS AND LOCATING TARGET
S305.8
EVALUATING RANGES OF PATTERN TO VERIFY TARGET

RANGE-FINDING BASED IMAGE PROCESSING RAIL WAY SERVICING APPARATUS AND METHOD

CROSS REFERENCE TO RELATED APPLICATION

This application incorporates and claims the benefit of U.S. Provisional Application Serial No. 60/258,080, filed Dec. 22, 2000, by K. Dexter Roberts, entitled Spiker Eye (Laser Actuated Tie Finder).

BACKGROUND OF THE INVENTION

The repair and maintenance of railroad rights of way have always been of prime consideration to ensure safe and reliable passage of passenger and freight trains. The railroad tracks upon which these trains travel are subject to frequent and heavy traffic and loading. The cost of maintaining these tracks also is commensurate with such traffic and requires significant expenditures for materials as well as labor for installation of the materials.

In particular, railroad companies constantly engage in such maintenance activities as replacing worn cross ties or the rails which they support. Typically, the worn cross tie or rail must be removed from where it is installed, and then a new cross tie or rail must be fitted and ultimately installed in place of the worn member.

Installing a cross tie involves positioning a tie on the railway bed and mechanically vibrating the surrounding ballast or stone so that the ballast flows around the tie providing support and resistance to tie movement.

Once the cross tie is placed, the rail then must be fastened to the cross tie. Typically, a rail is connected to a cross tie with a tie plate. A tie plate has a slot which receives and maintains the base of the rail and holes for receiving spikes which fasten the tie plate to the cross tie.

Many devices have been advanced for automating the installation of cross ties and rails. Some devices index a tamping mechanism according to a distance traveled by the tamping mechanism along the rail. See, for example, U.S. Pat. Nos. 4,760,797 and 5,671,679.

Another device employs a CCD camera for two-dimensional, shape-from-shading or parallax based image recognition for locating the spike holes in a tie plate on a cross-tie of a railway, as opposed to the present three-dimensional, range-based surface profiling identification and verification. See, for example, U.S. Pat. No. 5,487,341.

Unfortunately, the everyday unpredictable environmental surface conditions of a railroad bed limit the ability of image recognition based systems to accurately locate target features of a railroad bed. What is needed is a method and an apparatus for identifying a feature of a railway and deploying equipment for servicing same by image processing range data pertaining to the railway feature.

SUMMARY OF THE INVENTION

The invention overcomes the issues discussed above with a method and an apparatus for identifying a feature of a railway and deploying equipment for servicing same by image processing range data pertaining to the railway feature.

The invention provides a method for servicing a railway including identifying a feature of a railway, wherein the identifying involves processing an image corresponding to ranges to the feature. The invention also provides an apparatus for servicing a railway including a vision system for determining a range to a feature of the railway and means for positioning equipment relative to, for servicing, the feature, based on the range.

The invention may be used to retrofit existing track spiking machinery to automate locating a cross tie, detecting a tie plate and spike hole thereof, and inserting and driving the track spikes into the tie plate holes into the cross tie.

The invention provides improved elements and arrangements thereof, for the purposes described, which are inexpensive, dependable and effective in accomplishing intended purposes of the invention.

Other features and advantages of the invention will become apparent upon reference to the following description and drawings.

BRIEF DESCRIPTION OF THE DRAWINGS

The invention is described below in conjunction with the following drawings, throughout which similar reference characters denote corresponding features, wherein:

FIG. 11 is a diagrammatic view of a flow chart of a method according to the invention;

FIG. 12 is a diagrammatic view of a flow chart of a submethod of the method of FIG. 11;

FIG. 13 is a display view of a range-based image of a tie edge;

FIG. 14 is a diagrammatic view of a flow chart of a submethod of the method of FIG. 11;

DETAILED DESCRIPTION OF THE PREFERRED EMBODIMENTS

The invention is a method and an apparatus for identifying a feature of a railway and deploying equipment for servicing same by image processing range data pertaining to the railway feature. Herein, "servicing" refers to installing as well as repairing activities.

Figure 1:
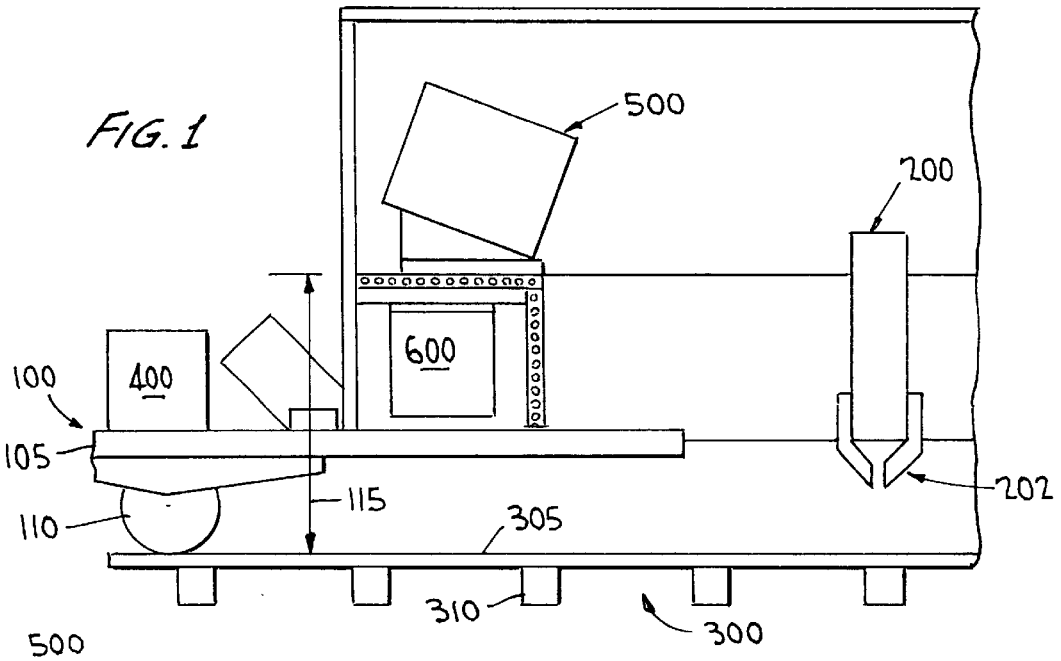
FIG. 1 is schematic side view of a range-finding based image processing railway servicing apparatus according to the invention.

FIG. 1 illustrates an embodiment of a range-finding based image processing railway servicing apparatus configured according to the invention. A carriage 100 transports railway servicing equipment 200 along a railway 300. A motive system 400 moves carriage 100 relative to railway 300. A vision system 500 identifies features of railway 300. A system controller 600 coordinates functions among equipment 200, motive system 400 and vision system 500.

Carriage 100 includes a frame 105 which is supported by at least two sets of rotatable wheels 110 that engage rails 305 of railway 300. Frame 105 and wheels 110 are linked so as to provide a relatively stable and constant vertical dimension 115 between vision system 500 and rails 305 of railway 300. The vertical dimension between vision system 500 and other features of railway 300 typically varies from work site to work site. The stability and consistency of dimension 115 impacts the accuracy of vision system 500, hence positioning of carriage 100 relative to railway 300, as described in greater detail below.

Equipment 200 is selected from a variety of automated devices for servicing railways. For example, as discussed in greater detail below, equipment 200 may include a tie nipper 202, for seizing and positioning railway ties 310.

Motive system 400 includes a propulsion means (not shown), for physically moving or driving carriage 100, and a propulsion controller (not shown), for regulating the extent that propulsion means moves carriage 100. The propulsion means may be selected from any conventional railroad car propulsion means, such as an electric stepper motor operatively coupled to at least one of the set of wheels 110. The propulsion means positions carriage 100 relative to a desired position along railway 300 with a precision appropriate for permitted tolerances of particular railway servicing. For example, positioning railway tie tamping equipment proximate to a tie for tamping does not require the accuracy that positioning spiking equipment relative to a spike hole of a tie plate for securing a rail to a tie, as described in greater detail below.

The propulsion controller, responsive to user or system controller 600 input, controls the propulsion means. Thus, when the user or system controller 600 instructs the propulsion controller to move carriage 100 by a certain amount, the propulsion controller transmits a motive signal to the propulsion means to move carriage 100 by the certain amount. Any of a number of known sensors may be used to apprize the propulsion controller as to the actual amount the propulsion means moves carriage 100 relative to railway 300 for providing control feedback.

Figure 2:
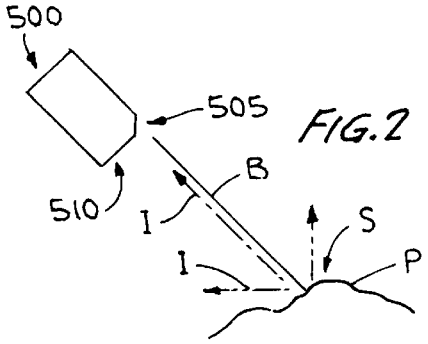
FIG. 2 is a schematic side view of the vision system of FIG. 1.
Figure 3:
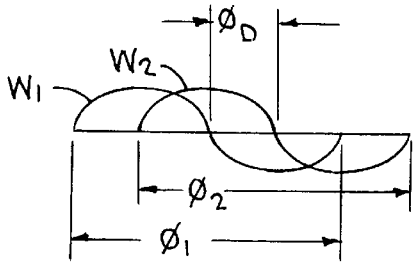
FIG. 3 is a graphical view of phases of laser light incident on and corresponding infrared energy emanating from a surface.

Referring to FIG. 2, vision system 500 employs light infrared detection and ranging (LIDAR) for identifying features of a railway 300 in a manner similar to radar. Vision system 500 includes a laser emitter 505, an infrared sensor 510 and an image processor (not shown). Laser emitter 505 emits an amplitude-modulated laser beam B across surface S. Surface S absorbs energy from laser beam B and radiates some of that energy in the form of infrared electromagnetic waves I. Sensor 510 receives some of the infrared electromagnetic waves I and transmits a signal corresponding to the phase of the received infrared energy to an image processor. As discussed in greater detail below, the image processor compares the phase of the irradiated laser beam with phase of the corresponding infrared energy and generates a virtual surface which corresponds to the actual surface irradiated by laser beam B.

The image processor identifies features from the virtual image that correspond to a target feature of the actual surface, such as rail 305 or tie 310. Thus, the image processor ascertains a location, in three-dimensional space, of an actual target feature of a rail, tie or other element of a railway. Similarly, the image processor ascertains a location, in three-dimensional space, of a target feature of equipment maintained by carriage 100, such as the tip of a spike extending from a spiking gun. Thus, the image processor provides positional information regarding a feature of a railway and equipment for servicing same so that the equipment may be positioned relative to the feature to perform such servicing.

Referring again to FIG. 1, system controller 600 receives positional information regarding railway and equipment features from the image processor. When service provided by the equipment is desired, system controller 600 controls motive system 400 to position carriage 100 along railway 300 relative to a feature for which servicing is desired, then controls the equipment controller to position and instruct the equipment for performing the desired service.

FIGS. 2–5 illustrate how vision system 500 develops a virtual surface that corresponds to an actual surface subjected to laser irradiation. Laser emitter 505 emits an amplitude-modulated laser beam B having a first waveform $W_1$ at a first phase $\phi_1$ that strikes actual surface S. Surface S absorbs energy from laser beam B and radiates some of that energy in the form of infrared electromagnetic waves I having a second waveform $W_2$ at a second phase $\phi_2$. Sensor 510 receives some of the infrared electromagnetic waves I and transmits a corresponding signal conveying the phase information of the infrared electromagnetic wave to an image processor (not shown). The image processor samples the signal from sensor 510 and determines a distance or range to surface S based on a phase difference $\phi_D$ between first phase $\phi_1$ of the outgoing laser beam with second phase $\phi_2$ of the received infrared energy wave. The value of phase difference $\phi_D$ depends on, thus is indicative of, the relative distance to the irradiated surface from laser emitter 505. An actual distance to, or range of, the irradiated surface is determined by converting the phase difference $\phi_D$ with a calibrated conversion factor derived from comparing phase differences $\phi_D$ associated with known actual distances.

Figure 4:
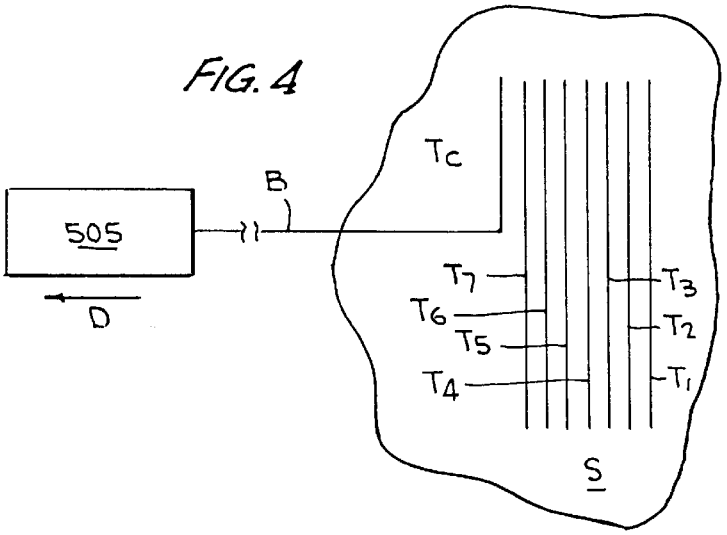
FIG. 4 is a schematic plan view of the vision system of FIG. 1 irradiating a generic surface.
Figure 5:
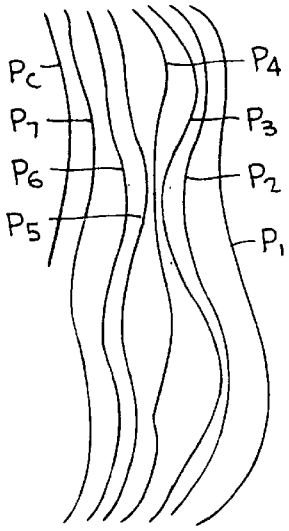
FIG. 5 is a graphical view of profiles traced by the laser of the vision system of FIG. 4.

As shown in FIG. 4, laser emitter 505 emits laser beam B across surface S, defining successive traces $T_1$–$T_n$ across surface S as laser emitter traverses relative to surface S along direction D. Traces $T_1$–$T_n$ of FIG. 4 correspond to profiles $P_1$–$P_n$ of surface S shown in FIG. 5.

The image processor structures the range data obtained to correspond with actual surface S by factoring in the rate at which laser beam B traverses surface S, the sampling rate for sampling phase difference data and the proximity between traces $T_1$–$T_n$. Thus, image processor generates data comprising a matrix of ranges to discrete points, defining a virtual surface that corresponds with actual surface S. Increasing the sampling time and/or decreasing the distance between traces $T_n$ improves resolution, hence correspondence of the virtual surface with actual surface S.

Figure 6:
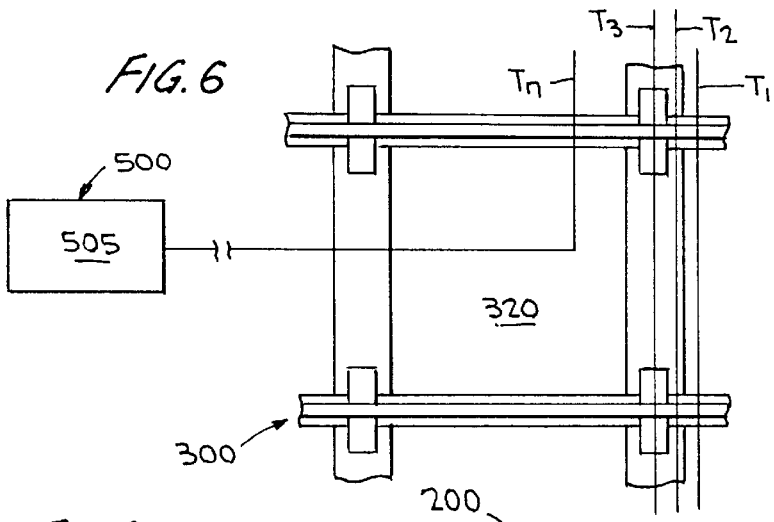
FIG. 6 is a schematic plan view of the vision system of FIG. 1 irradiating a railway.
Figure 7:
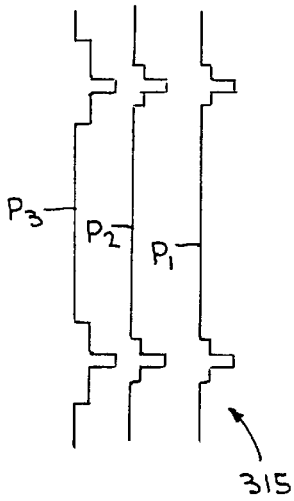
FIG. 7 is a graphical view of profiles traced by the laser of the vision system of FIG. 6.

FIGS. 6 and 7 illustrate a typical actual surface, railway 300, which vision system 500 is likely to encounter during railway servicing. Laser emitter 505 emits laser beam B, defining traces $T_1$–$T_n$ across railway 300 which correspond to profiles $P_1$–$P_n$, shown in FIG. 7. An infrared sensor (not shown in FIGS. 6 and 7) receives some of the resultant infrared electromagnetic waves and transmits a corresponding signal conveying the phase information thereof to an image processor (not shown), which generates a corresponding, range-based virtual surface. With sufficient resolution, the virtual surface exhibits features that correspond to features of railway 300, for example, rails 305, ties 310 and the underlying railway bed 320.

The image processor is provided with range-based data corresponding to features of a typical railway or other user-designated features. Such data includes, for example, characteristic range values, like the height of a rail above which no other element of a railway occurs, typical slopes between points of a range-based image, and distances between typical slope changes. The image processor also is provided with image comparison software which permits the image processor to compare the data corresponding to a typical railway with the generated virtual surface to determine whether the actual railway appears to present a specified feature. Thus, the image processor permits identification of a typical rail, tie, tie plate or other railway features.

Figure 8:
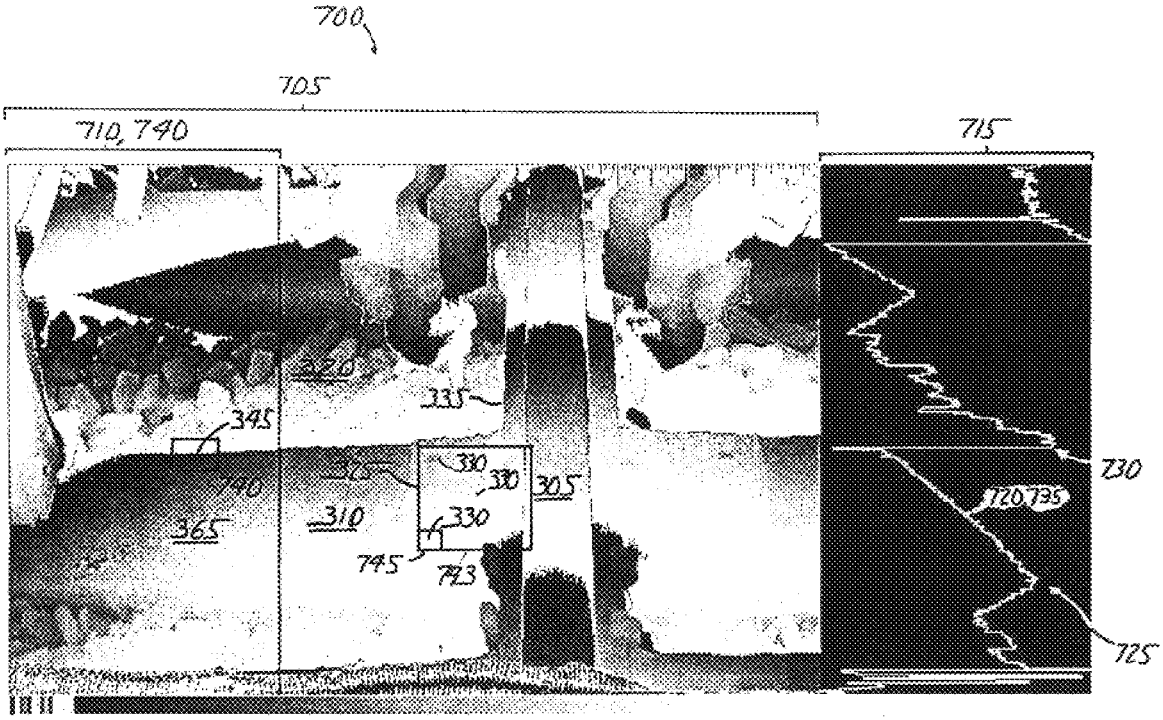
FIG. 8 is a display view of composite grey-scale image and feature analysis graph of an image processor corresponding to a portion of a railway.

FIG. 8 shows a composite virtual image and feature analysis graph display 700 of the image processor. An image portion 705 of display 700 shows rail 305, extending vertically with respect to the page, tie 310, tie plate 315 and railway bed 320. Shading of image portion 705 relates to ranges of depicted features from the infrared sensor, as opposed to the luminescence or coloration thereof. The image processor analyzes a window 710 of image portion 705 and generates a corresponding graph 715 having a profile 720. Profile 720 has contours that correspond to distinguishable elements in window 710. For example, transition points 725 and 730 respectively correspond to leading and trailing edges 340 and 345, and curve 735 corresponds to an upper surface 365 of tie 310. The image processor, having been provided data as to the distance between transition points 725 and 730, the slope of curve 735 or other defining relationships, identifies leading and trailing edges 340 and 345, upper surface 365 and so forth from image analysis of graph 715.

Once the image processor recognizes an attribute, the invention provides for verifying that the attribute identified actually is an attribute and not a misidentification. To make sure that identified attributes are not coincidental image aberrations, the image processor performs range analysis of the attribute. For example, if an area of a range-based virtual image appears to have transition points and slopes that generally correspond with image data for a spike hole, but in fact is a protruding bolt, subsequent range-finding analysis will reveal same.

The bulk of services performed on or about a railway are specific to certain features of the railway. For example, tie tamping requires locating appropriate equipment proximate to a tie and rail spiking requires locating appropriate equipment relative to a spike hole in a tie plate. To automate such services with the imaging capabilities of vision system 500, in addition to ascertaining a particular feature of a railway, equipment 200 for servicing the particular feature must be positioned relative to the particular feature. Thus, automating such service requires ascertaining the relative location of features of an actual surface and positioning equipment 200 accordingly for servicing same.

Figure 9:
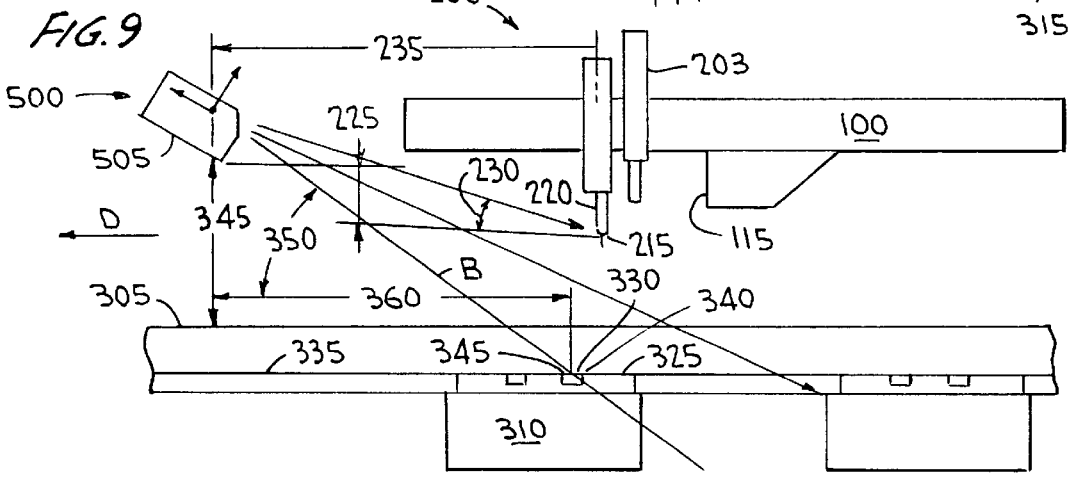
FIG. 9 is side schematic view of the embodiment of FIG. 1.

Referring to FIG. 9, the invention provides for ascertaining the relative location of a feature of an actual surface and positioning equipment 200 accordingly for servicing same. Initially, the invention provides for ascertaining a range of the equipment much like the present method for ascertaining features of railway 300. Vision system 500 performs range finding with respect to known features of equipment 200. Thus, the relative location of equipment 200 with respect to vision system 500 is determined. Next, as shown in FIG. 9, vision system 500 ascertains a differential range between tie 310 and a target feature of railway 300. Apprized of the position of and a differential range for positioning equipment 200, the invention automatically positions equipment 200 relative to a railway feature for servicing same.

For example, equipment 200 may include, inter alia, a spiking gun 210, such as a Fairmont Tamper Model E3 Spiker, for driving spikes (not shown) through spike holes 330 in tie plate 325, thereby securing the foot 335 of rail 305 to tie 310. Relative positioning of equipment 200 and vision system 300 is known from initial range finding start-up procedures. Thus, relative positioning of a spike hole to a known feature of railway 100, tie 310, must be determined for positioning equipment 200 relative thereto. Based on virtual image data provided to the image processor regarding the actual surface, the image processor determines a differential range between identified and verified spike hole and tie 300. System controller 600 then controls equipment controller 205 to position equipment 200 according to the differential range relative to the feature identified by the image processor for which servicing is desired.

An advantage of the range finding based correlation of equipment 200 and railway feature positions is that no cumulative positioning errors can accrue, as occurs with systems that rely on physical measurement of service surfaces, which eventually lead to erroneous positioning of equipment relative to a service surface and faulty servicing thereof. For example, systems that ascertain carriage position relative to a railway by physically measuring the length of rail passing thereunder, directly or via a wheel traversing the rail, even if calibrated carefully, accrue slight positional errors between successive actual and measured positions, which eventually lead to positioning equipment, such as a spiking gun, considerably astray from a spike hole.

In other embodiments of the invention, equipment 200 may include: a tamper (not shown) for installing a tie into a prepared section of railway bed 320; rail anchor adjusters (not shown) for seizing and positioning rail anchors; rail anchor spreaders (not shown) for providing adequate space for removing an undesired tie and replacing same with a new tie; Pandrol screw machines and clip applicators (not shown), for connecting rails, tie plates and ties with screws and clips; tie drilling machines (not shown), for drilling holes in ties; liquid tie plugging equipment (not shown), for plugging holes in ties; and other equipment available for servicing a railway that is specific to features of the railway.

Figure 10:
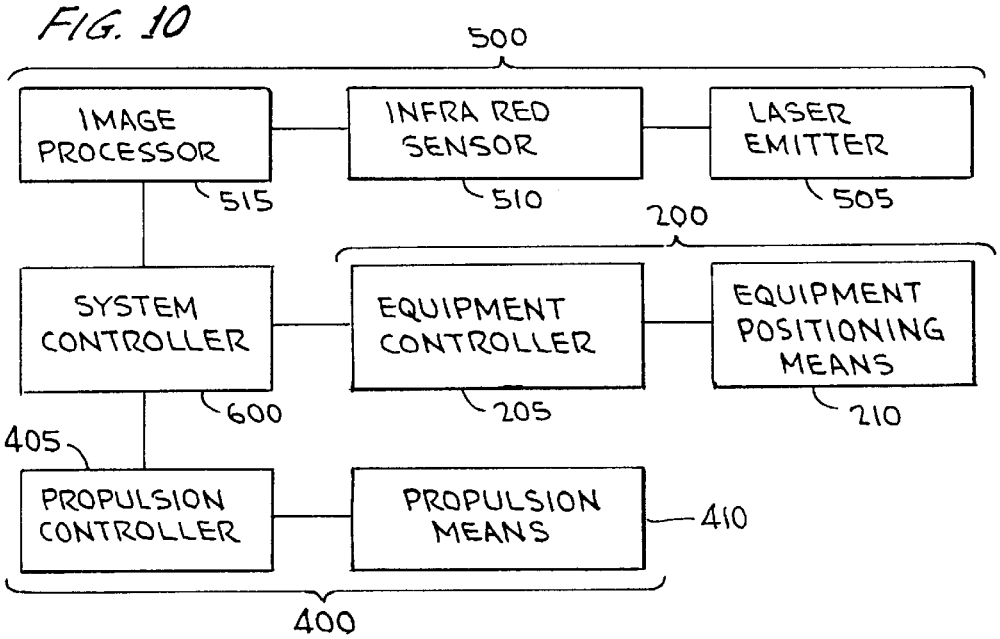
FIG. 10 is diagrammatic view of functional interrelationships among components of the embodiment of FIG. 1.

FIG. 10 diagrammatically outlines exemplary functional interrelationships among the foregoing components as background for subsequent discussion of a method configured according to the invention. Generally, system controller 600 receives input from vision system 500 and provides input to motive means 400. More specifically, within vision system 500, infrared sensor 510 receives input from laser emitter 505, regarding output laser emission phase, and outputs same, along with data regarding the phase of sensed infrared waves corresponding to the laser emission, to an image processor 515. Image processor 515 outputs to system controller 600 data derived from the data received from infrared sensor 510. Within motive means 400, propulsion controller 405 receives input from system controller 600 pertaining to a desired distance to move carriage relative to railway 300. Propulsion controller 405 determines the proper velocity and acceleration based upon the distance, grade, pre-programed parameters and machine responsiveness, and provides corresponding input for controlling the activity of propulsion means 410 to move carriage 100 the desired amount relative to railway 300.

FIG. 11 diagrammatically outlines basic features of a range-finding based image processing railway servicing method configured according to the invention. At step S100, the method provides for identifying a worksite of a railway. At step S200, the method provides for positioning carriage 100 carrying equipment 200 relative to the work site feature. At step S300, the method provides for identifying an attribute of the work site feature which equipment 200 is to service. At step S400, the method provides for positioning equipment 200 relative to the work site attribute. At step S500, the method provides for servicing the worksite with the equipment.

More specifically, step S100 includes step S105 for identifying a worksite feature. Example worksite features are a rail, a tie, a tie plate, an anchor or other common features found on a railway. A user may input image data associated with a desired target feature and attributes thereof or select same from a catalog of images provided to the image processor.

"Identifying" means establishing correspondence between data pertaining to a predicted image of a desired feature of the railway and an actual image of the feature. For example, if desired servicing includes tamping a tie into a prepared section of a railway bed, the method would provide for identifying the tie. To this end, in accordance with the method, a user would provide an image processor of a vision system, as described above, with data corresponding to an anticipated image of a tie. The vision system would scan the railway and provide corresponding range information to the image processor. The image processor would compare the anticipated tie image with features of the generated virtual surface. When the vision system scans an actual tie, the image processor would generate a virtual surface corresponding to the actual tie. Once the image processor determines the existence of correspondence between the virtual surface corresponding to the actual tie and the anticipated tie image, the image processor has identified the worksite feature, the tie. Herein, "locating" is used interchangeably with "identifying."

At step S110, the method provides for verifying the work site feature. Verification assures that an identified element of a virtual surface has the characteristics of a desired element, rather than an element that only looks like the element. For example, a groove in tie 310 could be represented on virtual surface as a dark line, which would have potential for being identified as a leading or trailing edge. To make sure that the equipment does not service the wrong part of a tie, the method verifies whether the dark line is an edge or a groove along tie 310.

Figure 15:
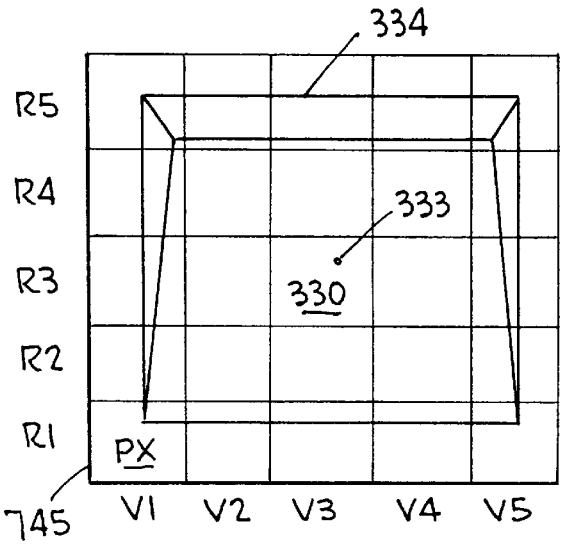
FIG. 15 is a display view of a range-based image of a spike hole.

Referring to FIG. 12, the method of step S110 provides a step S110.1 for positioning an analysis window 740 about a feature attribute identified by the image processor, for example, trailing edge 345, as shown in FIG. 8 and in an enlarged scale in FIG. 15. At step S110.2, the method provides for extracting the range values for each pixel PX of five vertical columns V1–V5 of pixels PX in window 740. As shown, each column V1–V5 contains five rows R1–R5 of pixels PX. At step S110.3, the method provides for averaging the range values across each row R1–R5. Averaging each row avoids the potential for a local surface deformity, such as a pock mark, from distorting subsequent calculations. At step S10.4, the method provides for determining the slopes between the average range values to find an inflection point which would be indicative of an edge. At step 110.5, the method provides for comparing the determined slopes with an appropriate slope. At step 110.6, the method provides for comparing the measured distance from leading edge to the appropriate slope with a minimum distance to ensure that point where appropriate slope occurs is where appropriate for an actual trailing edge. For example, the appropriate slope must not exist within a minimum distance of ½ tie width. If the appropriate slope is determined to exist within ½ tie width, then a non-standard condition exists which may not be serviceable. At step 110.7, once the minimum distance is verified, the method provides for comparing the measured height of the tie with a minimum height. At step 110.8, following height verification, the method provides for declaring the feature "verified."

Returning to FIG. 11, once the work site feature is identified and verified, at step S115, the method provides for ascertaining the differential range to the work site feature for positioning carriage 100 relative to the work site feature. To this end, the image processor determines a distance between a current location, identified and verified previous to step S100, and an intended location, respectively identified and verified in steps S105 and S110.

At step S200, the method provides for positioning carriage 100 relative to the work site feature according to the differential range thereto. System controller 600 receives the differential range information from the image processor and transmits a corresponding propulsion signal to propulsion controller 405. Propulsion controller 405 responds to the propulsion signal and transmits instructions regarding the proper velocity and acceleration to propulsion means 410 to move carriage 100 relative to railway 300 an amount corresponding to the differential range, thereby positioning carriage 100 proximate to the identified and verified work site feature.

Step S200 not only positions carriage 100, but also generally positions equipment 200 relative to the identified and verified work site feature. Subsequent step S400 fine tunes the positioning of equipment 200 by manipulating same relative to carriage 100 with equipment positioning means 210, as described below. Generally positioning equipment 200 relative to the work site feature by moving carriage 100 factors in the location of equipment 200 with respect to carriage 100.

Figure 17:
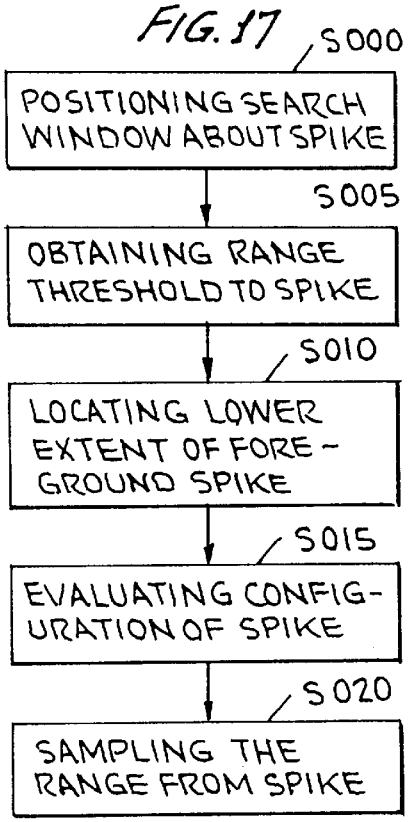
FIG. 17 is a diagrammatic view of a flow chart of a submethod of the method of FIG. 11.
Figure 18:
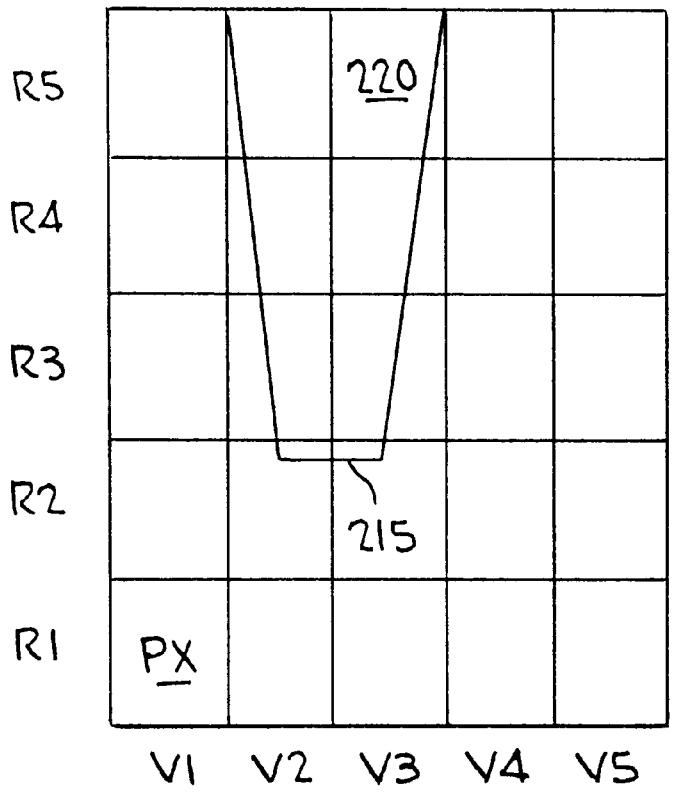
FIG. 18 is a display view of a range-based image of a spike.

Referring to FIG. 17, the method provides a sub-method for ascertaining the location of equipment 200, more specifically a fiducial point thereof, such as a spike tip, with respect to carriage 100. The sub-method may be executed once prior to performing any of a number of services with equipment 200, as part of every service performance by equipment 200, or at times and frequencies deemed appropriate. Step S000 provides for positioning a search window about where a fiducial point is expected, such as about spike 220, as shown in FIG. 20. Step S005 provides for obtaining a range threshold to the fiducial, spike 220. Step S010 provides for locating the lower extent of foreground spike 220. Step S015 provides for evaluating the configuration, or taper, cant and width, of spike 220. Step S020 provides for sampling the range to spike 220 and determining a range to the fiducial point. The image processor stores this range for subsequent carriage positioning calculations so that the fiducial point of equipment 200 may be positioned generally proximate to a work site feature.

Returning to FIG. 11, at step S300, the method provides for identifying an attribute, such as a tie plate spike hole, of the work site feature. As with step S100, user may input image data associated with a desired target attribute select same from a catalog of images provided to the image processor.

At step S305, the method provides for verifying the feature attribute. Verification assures that an identified attribute of a virtual surface has the characteristics of a desired attribute, rather than an attribute that only looks like an attribute. For example, a gouge in tie plate 325 could be represented on virtual surface as a dark square, which would have potential for being identified as a spike hole. To make sure that the equipment does not introduce a spike into a gouge, the method verifies whether the dark square is a hole.

FIG. 14 diagrams a sub-method of step S305 for verifying identified spike holes 330 in tie plate 325. Step S305.1 provides for positioning an analysis window 743 around a target, spike holes 330, and a reference feature, rail foot 335, as shown in FIG. 8. Ascertaining ranges for the reference aids in making sure that tie plate and spike holes are situated appropriately vertically relative to rail 305. Step S305.2 provides for ascertaining and normalizing the range to reference rail foot 335. Step S305.3 provides for filtering noise associated with the reference ranging. Step S305.4 provides for determining a range threshold of the reference. Step S305.5 provides for extracting a local edge of the reference, rail foot 335, with the column averaging technique described above.

Referring also to FIG. 15, which shows spike hole 330 in an enlarged scale, the method continues at step S305.6, which provides for extracting a "stripe" of pixels across the attribute, spike hole 330, similar to that described above for step S110.2. Step S305.7 provides for analyzing the stripe and locating a target of the attribute, a leading edge of spike hole 330. Step S305.8 provides for evaluating the configuration of ranges in the pattern to verify the target, leading edge of hole 330.

Figure 16:
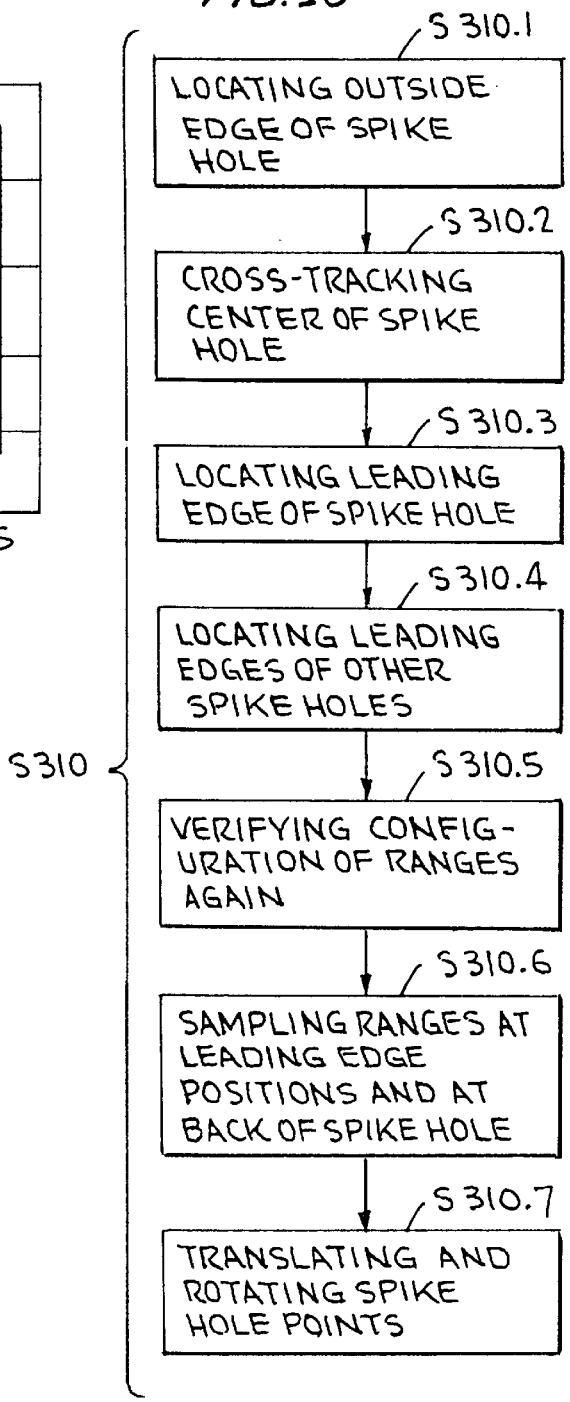
FIG. 16 is a diagrammatic view of a flow chart of a submethod of the method of FIG. 11.

Returning to FIG. 11, at step S310, the method provides for ascertaining a differential range between the attribute, spike hole 330, and equipment 200. Referring to FIG. 16, step S310 includes step S310.1, which provides for locating the outside edge, or edge farthest from the rail base, of spike hole 330, as shown in FIG. 15. Step S310.2 provides for cross-tracking, or identifying the theoretical, center 333 of spike hole 330. Step S310.3 provides for locating the leading edge 334 of spike hole 330. Step S310.4 provides for locating the leading edges (not shown) of the other spike holes (not shown). Step S310.5 provides for verifying the configuration of ranges in pattern again. Step S310.6 provides for sampling the ranges at the three leading edge positions and at back of the spike holes. Step S310.7 provides for translating and rotating spike hole points.

Step S310.7 employs ordinary trigonometric formulae to establish a horizontal relationship between the spike holes and the equipment selected to service same, a spiking gun. Referring again to FIG. 2, based on the range data for points 340 and 345, the distance 350 between infrared sensor 510 and rail 305 and the angle 355 relative to rail 305 at which laser beam B is directed across railway 300, the image processor determines a distance 360 along rail 305 from sensor 510 to, for example, a center of spike hole 330.

Returning again to FIG. 11, at step S400, the method provides for positioning equipment 200 relative to the feature attribute according to the differential range thereto. System controller 600 receives the differential range information from the image processor and transmits a corresponding positioning signal to equipment controller 205. Equipment controller 205 responds to the positioning signal and transmits instructions regarding the proper velocity and acceleration to equipment positioning means 210 to move equipment 200 relative to carriage 100 and/or railway 300 an amount corresponding to the differential range, thereby positioning equipment 200 proximate to the identified and verified work site feature attribute.

Figure 19:
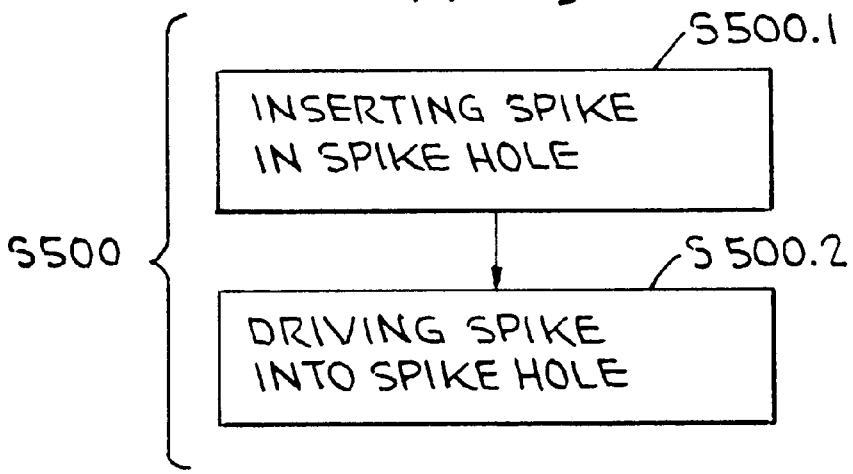
FIG. 19 is a diagrammatic view of a flow chart of a submethod of the method of FIG. 11.

At step S500, once the equipment is positioned, the method provides for servicing the work site with the equipment. As shown in FIG. 19, step S500 includes step S500.1, which provides for inserting spike 220 in spike hole 330. Step S500.2 provides for driving spike 220 into spike hole 330.

Although the present invention has been described in relation to particular embodiments thereof, many other variations and modifications and other uses will become apparent to those skilled in the art. The present invention is not limited by the specific disclosure herein, but only by the appended claims.

I claim:

1. A method of servicing a railway, said method comprising:

identifying a feature of a railway based upon a range measurement from a vision system to the feature being identified, said vision system employing light infrared detection and ranging;

irradiating the feature by at least one laser beam emitted by at least one laser emitter;

sensing energy radiated from the feature due to said irradiation by said laser beam by at least one infrared sensor;

transmitting at least one signal corresponding to a property of said sensed energy;

comparing a property of said emitted laser beam to said transmitted signal for three-dimensional identification of the feature;

processing a three-dimensional image of the feature based upon the range measurement; and servicing the railway.

2. Method of claim 1, wherein said identifying comprises establishing correspondence between the image and data pertaining to a predicted image of the feature.

3. Method of claim 1, further comprising verifying the feature.

4. Method of claim 3, wherein said verifying comprises:

locating an inflection point on the image indicative of an attribute of the feature;

ascertaining a slope at the inflection point; and determining whether the slope falls within a predetermined range.

5. Method of claim 4, further comprising:

measuring a distance from the inflection point to another attribute of the feature; and determining whether the distance falls within a predetermined range.

6. Method of claim 4, further comprising:

measuring a height of the inflection point; and determining whether the height falls within a predetermined range.

7. Method of claim 3, wherein said verifying comprises:

extracting range values for each pixel of a plurality of columns of pixels of the image;

determining average range values across each row across the columns;

determining slopes between the average range values;

locating an inflection point indicative of an attribute of the feature from the slopes;

ascertaining a slope at the inflection point; and determining whether the slope falls within a predetermined range.

8. Method of claim 7, further comprising:

measuring a distance from the inflection point to another attribute of the feature; and determining whether the distance falls within a predetermined range.

9. Method of claim 7, further comprising:

measuring a height of the inflection point; and determining whether the height falls within a predetermined range.

10. Method of claim 1, further comprising positioning equipment relative to, for servicing, the feature based on said identifying.

11. Method of claim 10, wherein said positioning comprises ascertaining a range to a fiducial point of the equipment.

12. Method of claim 10, wherein said positioning comprises determining a differential range between a current position and a position associated with the feature.

13. Method of claim 10, wherein:

the equipment is mounted on a carriage that is moveable relative to the railway; and said positioning comprises instructing equipment positioning means to move the equipment, instructing carriage positioning means to move the carriage or combinations thereof.

14. Method of claim 1, further comprising positioning a carriage carrying equipment relative to, for servicing, the feature based on said identifying.

15. Method of claim 14, further comprising positioning the equipment relative to the carriage based on said identifying.

16. A method of servicing a railway, said method comprising:

locating a feature of a railway based upon a range measurement from a vision system the feature being located, said vision system employing light infrared detection and ranging;

irradiating the feature by at least one laser beam emitted by at least one laser emitter;

sensing energy radiated from the feature due to said irradiation by said laser beam by at least one infrared sensor;

transmitting at least one signal corresponding to a property of said sensed energy;

comparing a property of said emitted laser beam to said transmitted signal for three-dimensional identification of the feature;

positioning a carriage carrying equipment relative to, for servicing, the feature based on said locating;

identifying a three-dimensional attribute of the feature; and positioning the equipment with respect to the carriage relative to the attribute based on one or both of said locating and said identifying.

17. Method of claim 16, further comprising servicing the attribute with the equipment.

18. Method of claim 16, wherein one or both of said locating and said identifying comprises establishing correspondence between an actual image of the feature or attribute and data pertaining to a predicted image thereof.

19. Method of claim 18, wherein the actual image is based on range data.

20. Method of claim 16, further comprising verifying the feature.

21. Method of claim 20, wherein said verifying comprises:

locating an inflection point on an image of the feature which is indicative of an attribute of the feature;

ascertaining a slope at the inflection point; and determining whether the slope falls within a predetermined range.

22. Method of claim 21, wherein the image is based on range data.

23. Method of claim 21, further comprising:

measuring a distance from the inflection point to another attribute of the feature; and determining whether the distance falls within a predetermined range.

24. Method of claim 21, further comprising:

measuring a height of the inflection point; and determining whether the height falls within a predetermined range.

25. Method of claim 20, wherein said verifying comprises:

extracting range values for each pixel of a plurality of columns of pixels of an image of the feature;

determining average range values across each row across the columns;

determining slopes between the average range values;

locating an inflection point indicative of an attribute of the feature;

ascertaining a slope at the inflection point; and determining whether the slope falls within a predetermined range.

26. Method of claim 25, further comprising:

measuring a distance from the inflection point to another attribute of the feature; and determining whether the distance falls within a predetermined range.

27. Method of claim 25, further comprising:

measuring a height of the inflection point; and determining whether the height falls within a predetermined range.

28. Method of claim 16, further comprising verifying the attribute.

29. Method of claim 28, wherein said verifying comprises:

locating an inflection point on an image of the attribute which is indicative of an predetermined point of the attribute;

ascertaining a slope at the inflection point; and determining whether the slope falls within a predetermined range.

30. Method of claim 29, wherein the image is based on range data.

31. Method of claim 29, further comprising:

measuring a distance from the inflection point to another predetermined point of the attribute; and determining whether the distance falls within a predetermined range.

32. Method of claim 29, further comprising:

measuring a height of the inflection point; and determining whether the height falls within a predetermined range.

33. Method of claim 28, wherein said verifying comprises:

extracting range values for each pixel of a plurality of columns of pixels of an image of the attribute;

determining average range values across each row across the columns;

determining slopes between the average range values;

locating an inflection point indicative of a predetermined point of the attribute;

ascertaining a slope at the inflection point; and determining whether the slope falls within a predetermined range.

34. Method of claim 33, further comprising:

measuring a distance from the inflection point to another predetermined point of the attribute; and determining whether the distance falls within a predetermined range.

35. Method of claim 33, further comprising:

measuring a height of the inflection point; and determining whether the height falls within a predetermined range.

36. Method of claim 16, further comprising positioning equipment relative to, for servicing, the feature based on one or both of said locating and said identifying.

37. Method of claim 36, wherein said positioning comprises ascertaining a range to a fiducial point of the equipment.

38. Method of claim 36, wherein said positioning comprises determining a differential range between a current position and a position associated with the feature.

39. Method of claim 36, wherein:

the equipment is mounted on a carriage that is moveable relative to the feature; and said positioning comprising instructing equipment positioning means to move the equipment, instructing carriage positioning means to move the carriage or combinations thereof.

40. Method of claim 16, further comprising positioning a carriage carrying equipment relative to, for servicing, the feature based on one or both of said locating and said identifying.

41. Method of claim 40, further comprising positioning the equipment relative to the carriage based on one or both of said locating and said identifying.

42. Apparatus for servicing a railway, said apparatus comprising:

a vision system for determining a range from said vision system to a feature of the railway, said vision system being capable of three-dimensional identification of the feature and employing light infrared detection and ranging;

at least one laser emitter for emitting at least one laser beam for irradiating the feature;

at least one infrared sensor for sensing energy radiated from the feature due to said irradiation by said laser beam;

at least one transmitter for transmitting at least one signal corresponding to a property of said sensed energy;

a system for comparing a property of said emitted laser beam to said transmitted signal for three-dimensional identification of the feature;

means for positioning equipment relative to, for servicing, the feature, based on the range determination by said vision system; and means for identifying a three-dimensional attribute of the feature.

43. Apparatus of claim 42, wherein said system including an image processor for comparing the phase expressed by said transmitted signal with a phase of said laser beam and generating a range signal corresponding to the range, wherein said means for identifying being a sensor for sensing energy originating from the feature and generating a signal expressing the phase of the energy.

44. Apparatus of claim 42, further comprising a carriage for carrying said vision system and said means for positioning equipment.

45. Apparatus of claim 44, wherein said means for positioning equipment comprises carriage positioning means for moving the carriage relative to the railway, equipment positioning means for moving the equipment relative to said carriage, or combinations thereof.

46. Apparatus of claim 42, further comprising equipment for servicing the railway operably connected to said means for positioning.

47. Apparatus of claim 46, wherein the equipment comprises a tie tamper, a spiking gun, a rail anchor adjuster, a rail anchor spreader, a Pandrol screw machine, a Pandrol clip applicator, a tie drilling machine, liquid tie plugging equipment or combinations thereof.

48. Apparatus of claim 42, wherein said vision system comprises:

means for identifying all four sides of a spike hole; and means for directing motion of a spike gun both along a track and across a track.

* * * * *